US007243728B2

(12) United States Patent
Stoesz et al.

(10) Patent No.: US 7,243,728 B2
(45) Date of Patent: Jul. 17, 2007

(54) SLIDING SLEEVE DEVICES AND METHODS USING O-RING SEALS AS SHEAR MEMBERS

(75) Inventors: Carl W. Stoesz, Houston, TX (US); Calvin J. Stowe, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 179 days.

(21) Appl. No.: 11/073,435

(22) Filed: Mar. 7, 2005

(65) Prior Publication Data

US 2006/0196676 A1 Sep. 7, 2006

(51) Int. Cl.
*E21B 34/00* (2006.01)

(52) U.S. Cl. ..... 166/318; 166/242.6; 285/3

(58) Field of Classification Search ..... 166/318, 166/242.6; 285/3, 4
See application file for complete search history.

(56) References Cited

U.S. PATENT DOCUMENTS

| | | | | |
|---|---|---|---|---|
| 3,995,692 | A * | 12/1976 | Seitz | 166/318 |
| 4,570,707 | A * | 2/1986 | Setterberg, Jr. | 166/214 |
| 5,181,569 | A * | 1/1993 | McCoy et al. | 166/317 |
| 5,526,888 | A | 6/1996 | Gazewood | 175/320 |
| 5,584,512 | A | 12/1996 | Carstensen | 285/55 |
| 5,787,982 | A | 8/1998 | Bakke | 166/242.6 |
| 5,845,945 | A | 12/1998 | Carstensen | 285/321 |
| 6,196,325 | B1 | 3/2001 | Connell et al. | 166/377 |
| 6,209,653 | B1 | 4/2001 | Pringle | 166/382 |
| 6,213,206 | B1 | 4/2001 | Bakke | 166/242.7 |
| 6,439,305 | B1 | 8/2002 | Bakke | 166/242.6 |
| 6,708,761 | B2 | 3/2004 | George et al. | 166/297 |
| 2003/0089497 | A1 * | 5/2003 | George et al. | 166/297 |
| 2004/0045704 | A1 | 3/2004 | Bowles | 166/242.7 |
| 2005/0263295 | A1 * | 12/2005 | Carro | 166/387 |

* cited by examiner

*Primary Examiner*—David Bagnell
*Assistant Examiner*—Giovanna M. Collins
(74) *Attorney, Agent, or Firm*—Shawn Hunter

(57) ABSTRACT

Devices and methods for releasably securing components of a device having a sliding sleeve arrangement to prevent premature actuation due to vibration. In a currently preferred embodiment, standard elastomeric O-rings are used as shear members. The O-ring shear members reside within spaces formed between two slidable sleeve members. The O-rings are sheared cross-sectionally to allow the sleeve members to move axially with respect to one another. An exemplary coiled tubing shear release joint is described that incorporates a shear disconnect assembly which uses elastomeric O-rings as shear members. Multiple O-ring seals can be used as shear members to increase the shear value of the device. The use of O-rings as shear members helps prevent premature sliding of sleeve components in response to high vibration. Because the O-rings are resilient, they absorb vibration and do not shear during vibration, the connection between the two sleeve components will not be released prematurely.

18 Claims, 4 Drawing Sheets

Fig. 3
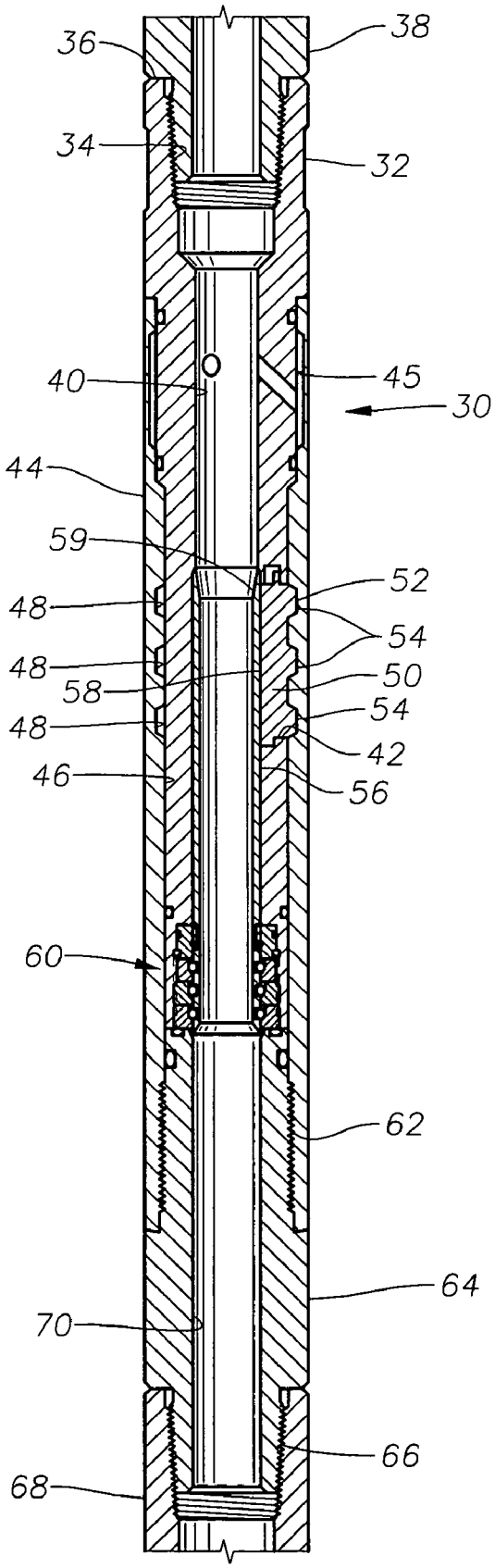
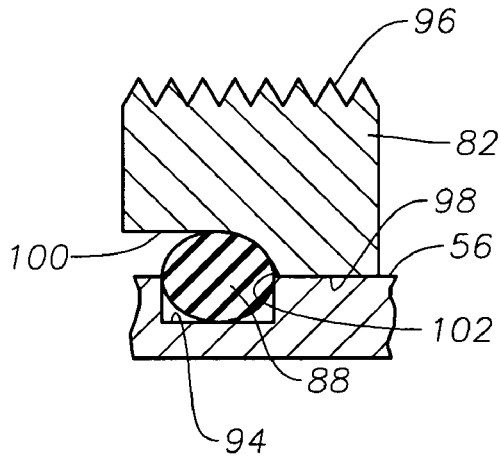
Fig. 6

SLIDING SLEEVE DEVICES AND METHODS USING O-RING SEALS AS SHEAR MEMBERS

BACKGROUND OF THE INVENTION

1. Field of the Invention

The invention relates generally to the use of O-ring seals, typically formed from elastomer, as shear members. In particular aspects, the invention relates to devices that utilize O-rings as shear members to resist the movement of an axially sliding sleeve.

2. Description of the Related Art

There is a variety of tools and devices used within a wellbore that incorporate sliding sleeves, or arrangements where one tubular member is slidably moved with respect to another tubular member to accomplish some function, such as actuation of a valve or a releasable disconnect. Traditionally, shear pins or other frangible members have been used to releasably secure these components together until it is desired to cause them to slide.

However, the use of frangible members to hold sleeve components together is problematic where the components are subject to high vibration. Vibration can rupture a frangible pin, thereby prematurely releasing the connection that holds the sleeve members together. This results in an undesired activation of the tool. One example of a tool that is normally subjected to high vibration during use is a coiled tubing shear release joint. These tools are used to provide a selective separation point in a continuous length of coiled tubing. The release joint may be activated by shearing of a shearable member, such as a frangible shear pin, to allow separation of release joint components. However, substantial vibration occurs during normal operation of coiled tubing production, and this vibration might cause the shear pin to fail prematurely, thus undesirably activating the release joint.

The present invention addresses the problems of the prior art.

SUMMARY OF THE INVENTION

The invention provides devices and methods for releasably securing components of a device having a sliding sleeve arrangement to prevent premature actuation due to vibration. In a currently preferred embodiment, the invention utilizes standard elastomeric O-rings as shear members. The O-ring shear members reside within spaces formed between two slidable sleeve members. The O-rings are sheared cross-sectionally to allow the sleeve members to move axially with respect to one another. An exemplary coiled tubing shear release joint is described that incorporates a shear disconnect assembly which uses elastomeric O-rings as shear members. Multiple O-ring seals can be used as shear members to increase the shear value of the device. The use of O-rings as shear members helps prevent premature sliding of sleeve components in response to high vibration. Because the O-rings are resilient, they absorb vibration and do not shear during vibration, the connection between the two sleeve components will not be released prematurely.

To the inventors' knowledge, elastomeric O-rings have not been heretofore utilized as shear members for the releasable securing of sliding sleeve arrangements. The conventional intended use for elastomeric O-ring members has been as fluid seals. As a result, it has been desired that O-ring members remain intact to provide for good fluid sealing rather than to deliberately destroy them.

BRIEF DESCRIPTION OF THE DRAWINGS

FIG. 3 is a side, cross-sectional view depicting an exemplary coiled tubing shear release joint that incorporates O-ring seal shear members, in accordance with the present invention.

FIG. 6 is a further enlarged view depicting details of an exemplary shear collar and O-ring shear member.

DETAILED DESCRIPTION OF THE PREFERRED EMBODIMENTS

The present invention relates broadly to the use of typical O-ring seals as shear members in tools and devices that feature axially sliding sleeves. Many devices that incorporate axially sliding sleeves are used in oil wells.

Figure 1:
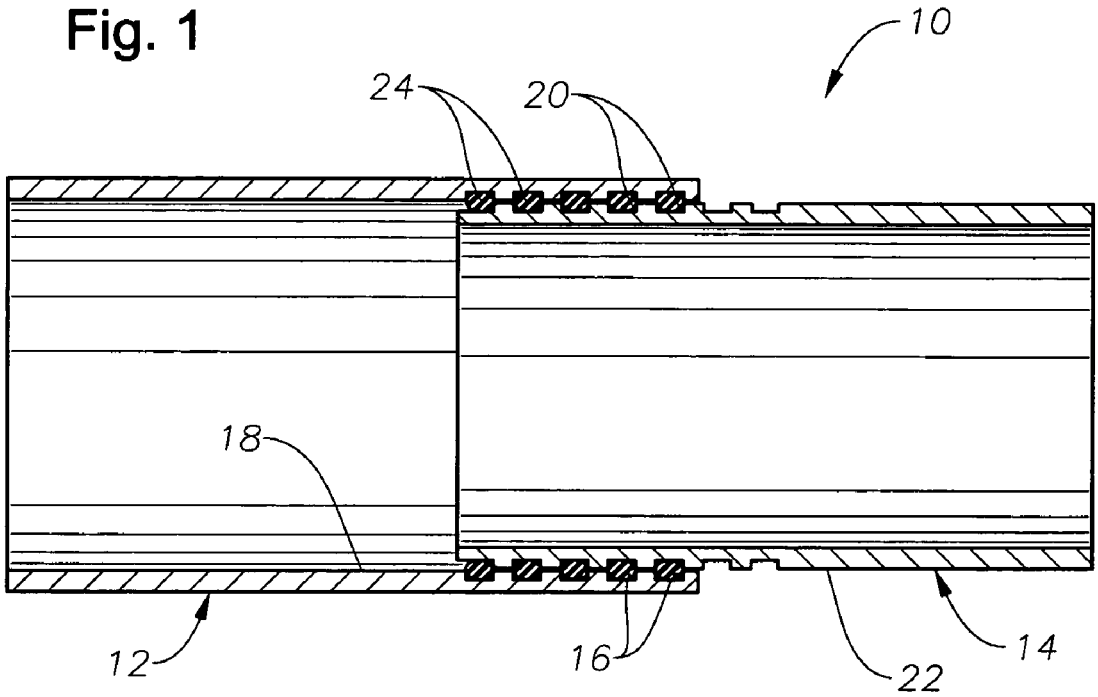
FIG. 1 depicts an exemplary sliding sleeve arrangement that incorporates O-ring seals as shear members.
Figure 2:
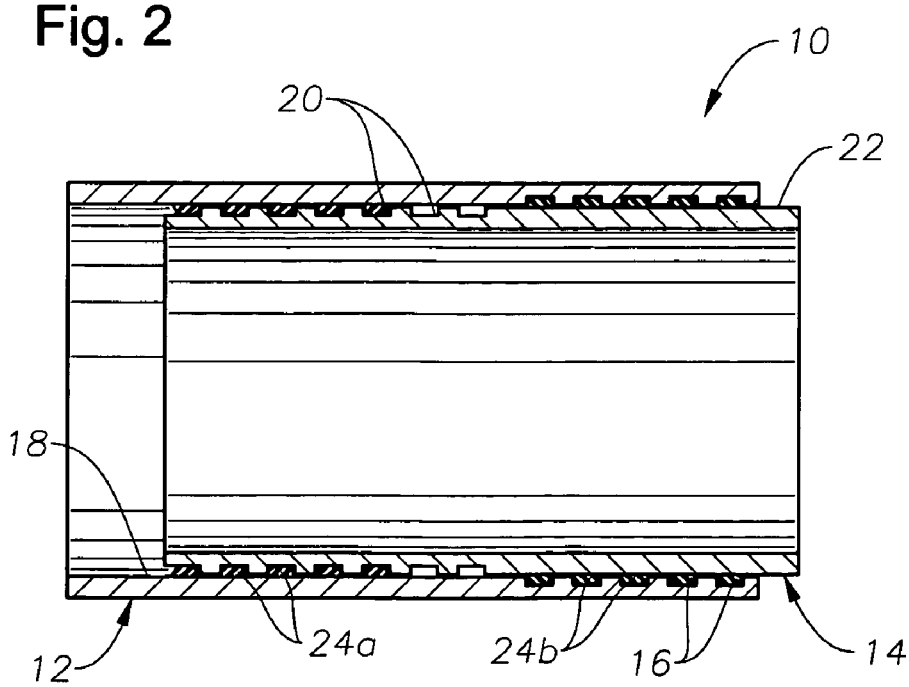
FIG. 2 illustrates the sliding sleeve arrangement shown in FIG. 1 now with the O-ring seals sheared.

FIGS. 1 and 2 illustrate an exemplary the general instance of a sliding sleeve apparatus 10 that incorporates elastomeric O-ring seals as a shear mechanism. The sliding sleeve apparatus 10 includes a radially outer sleeve 12 that partially surrounds a radially inner piston 14. The outer sleeve 12 defines a series of annular grooves 16 inscribed upon its interior surface 18. The inner piston 14 also defines a series of annular grooves 20 upon its outer surface 22. In the initial secured position, shown in FIG. 1, the grooves 20 on the inner piston 14 are aligned with the grooves 16 on the outer sleeve 12. O-ring members 24 reside within the spaces created by the alignment of grooves 16 and 20. While there are five O-ring members 24 shown, it will be understood that there may be more or fewer depending upon the amount of shear resistance desired. Each of the exemplary O-ring shear members 24 presents a substantially rounded cross-section, as shown, although other cross-sectional shapes may be utilized (i.e., square, rectangular, or other). In the position shown in FIG. 1, the inner piston 14 is secured in place with respect to the outer sleeve 12 by the O-rings 24, which prevent axial movement. In the case of vibration of the apparatus 10, the O-rings 24 are not ruptured.

The inner piston 14 may be moved with respect to the outer sleeve 12 by hydraulic actuation, a mechanical shifting tool, or in other ways known in the art. In order to move the inner piston 14 with respect to the outer sleeve 12, it is necessary to impart an axial force to the inner piston 14 that is greater than the shear resistance provided by the O-rings 24. When this amount of force is applied, the O-rings 24 split into ring portions 24*a*, 24*b*, as shown in FIG. 2, and the inner piston 14 is freed to move with respect to the outer sleeve 12. Ring portions 24*a* remain within the grooves 20 while ring portions 24*b* remain inside the grooves 16. Thus, it can be seen that a O-ring 24 will shear or be separated into two substantially annular pieces, as the ring 24 is separated along its cross-sectional area.

FIGS. 3-7 depict an exemplary coiled tubing shear release joint 30 that is constructed in accordance with the present invention. The shear release joint 30 is typically used within a wellbore (not shown) to create a separation point in coiled tubing. Thus, the shear release joint 30 includes an upper mandrel 32 with a box-type threaded connection 34 at its upper end 36 to be affixed to an upper section 38 of coiled tubing. The upper section 38 of coiled tubing typically extends to the surface of the wellbore. The mandrel 32 defines an axial flowbore 40 along its length. In addition, several lateral windows 42 (one shown) are disposed through the body of the mandrel 32.

A tubular housing 44 radially surrounds the mandrel 32. The upper end of the housing 44 provides a fishing neck 45. The inner surface 46 of the housing 44 includes several annular recesses 48. Dogs 50, reside loosely within the windows 42 of the mandrel 32. Although there is only one dog 50 visible in FIG. 4, it will be understood by those of skill in the art that there is typically two to four such dogs 50—one for each window 42. Each of the dogs 50 presents a radially outer face 52 that is shaped to provide teeth 54 that rest within the recesses 48 of the housing 44. As a result, the housing 44 and the mandrel 32 are secured to one another.

A shear sleeve 56 is disposed within the bore 40 of the mandrel 32 and abuts the inner surfaces 58 of the dogs 50, thereby holding them firmly in place so that the teeth 54 of the dogs 50 engage the recesses 48. The shear sleeve 56 has a ball seat 59 at its upper end. The lower end of the shear sleeve 56 is retained in place within the mandrel 32 by a shear disconnect assembly, generally shown at 60 in FIG. 3. The structure and function of the shear disconnect assembly 60 is more clearly understood by reference to FIGS. 4 and 5, and will be described in detail shortly.

Referring once again to FIG. 3, the lower end of the housing 44 is connected by threaded connection 62 to a bottom sub 64. The bottom sub 64, in turn, has a lower end with a pin-type threaded connection 66 by which the bottom sub 64 is secured to a lower section 68 of coiled tubing. An axial flowbore 70 is defined along the length of the bottom sub 64.

Figure 4:
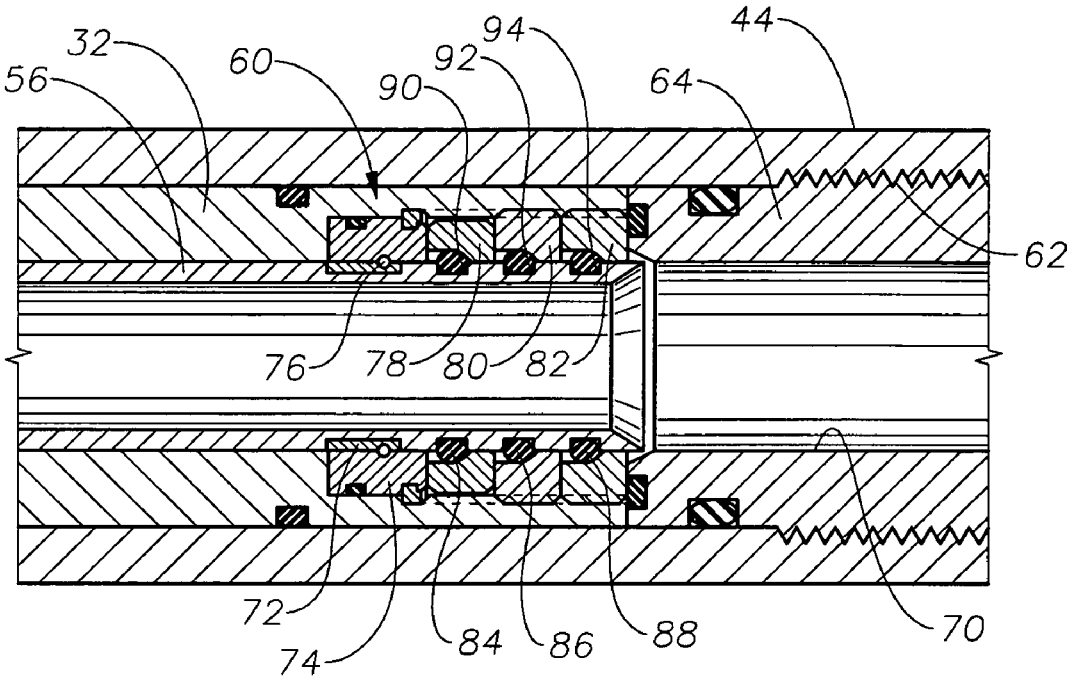
FIG. 4 is an enlarged view of shear disconnect assembly portions of the release joint shown in FIG. 3.
Figure 5:
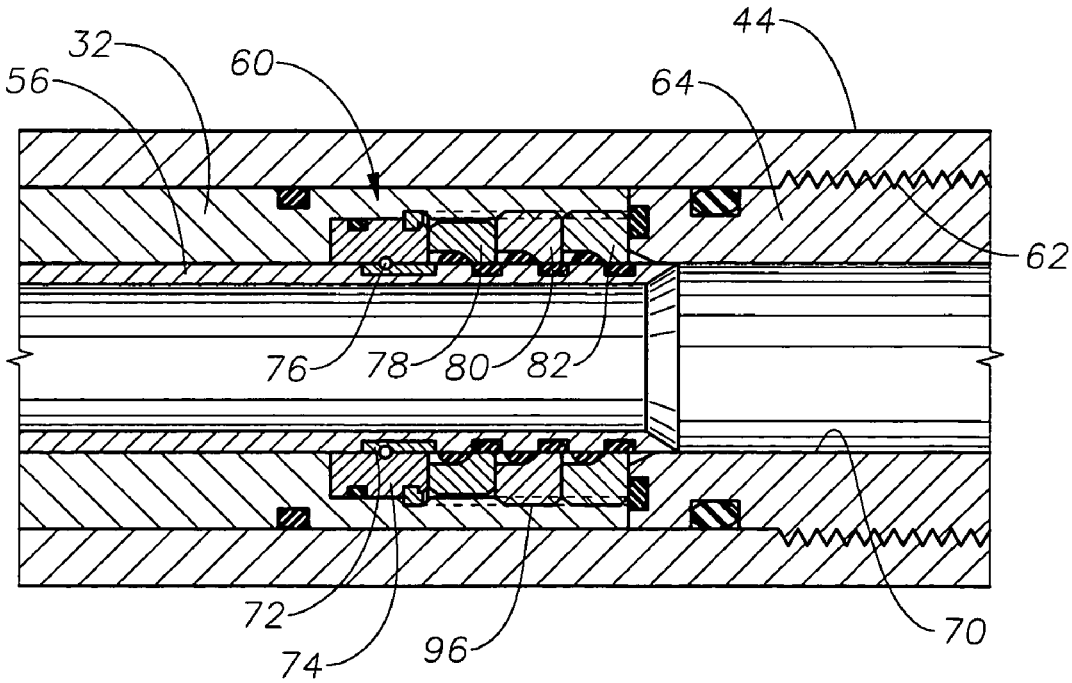
FIG. 5 is an enlarged view of the shear disconnect assembly portions shown in FIG. 4, now with the shear members having been sheared.

With reference to FIGS. 4 and 5, the shear disconnect assembly 60 includes an inner collar 72 that surrounds a lower portion of the shear sleeve 56. An outer collar, or shear pin retaining ring, 74 radially surrounds the inner collar 72. One or more standard frangible shear pins 76 are preferably disposed tangentially through the outer collar 74 and inner collar 72 to releasably secure those components together.

Below the outer collar 74 are three metallic, annular shear collars 78, 80, 82. Each of the three shear collars 78, 80, 82 has a similar configuration, which is illustrated in the further enlarged view provided by FIG. 6. Each shear collar 78, 80, 82 surrounds an elastomeric O-ring shear member 84, 86, 88, respectively, and each of the O-ring shear members 84, 86, 88 resides within a groove 90, 92, 94, respectively, that is formed within the outer surface of the shear sleeve 56. It is noted that the radially outer surface of each of the shear collars 78, 80, 82 is interengaged with the mandrel 32 via a toothed or threaded surface 96. As a result of this interengagement, the shear collars 78, 80, 82 will move in concert with the mandrel 32.

FIG. 6 depicts in closer detail the single shear collar 82 surrounding O-ring shear member 88 and groove 94. The structural features shown in detail here apply equally to the shear collars 78 and 80. It is noted that the shear collar 82 has a substantially flat inner side 98 that abuts the outer surface of the mandrel 56. An arcuately curved inner surface 100 extends upwardly and outwardly from the leading, cutting edge 102 of the inner side 98. The O-ring member 88 is trapped within the groove 94 by the curved inner surface 100. It is noted that the inner surface 100 might alternatively be angled rather than curved. In either case, the currently preferred angle of departure for the surface 100 is approximately 5°.

To activate the release joint 30, a ball 104 (shown in FIG. 7) is dropped through the upper coiled tubing section 38 and comes to rest on ball seat 59 of the shear sleeve 56. Fluid pressure is then increased behind the ball 104 until the force upon the shear sleeve 56 exceeds the shear value of the O-ring shear members 84, 86, 88. At that point, the shear sleeve 56 moves axially downwardly with respect to the mandrel 32 as the shear members 84, 86, 88 within the shear disconnect assembly 60 are sheared. Downward movement of the shear sleeve 56 with respect to the mandrel 32 causes the leading edge 102 of each of the shear collars 78, 80, 82 to engage each of the respective O-ring shear members 84, 86, 88 and cut them through their annular cross-sections, in a manner similar to the O-rings 24 described earlier (i.e., each of the shear members 84, 86, 88 is divided into two ring portions). Additionally, the standard frangible shear pin 76 is sheared by movement of the inner collar 72 with respect to the outer collar 74. The elastomeric shear members 84, 86, 88 absorb vibration of the components during operation and prevents premature axial movement of the shear sleeve 56 with respect to the mandrel 32 via an unintended rupture of the shear pin 76.

Figure 7:
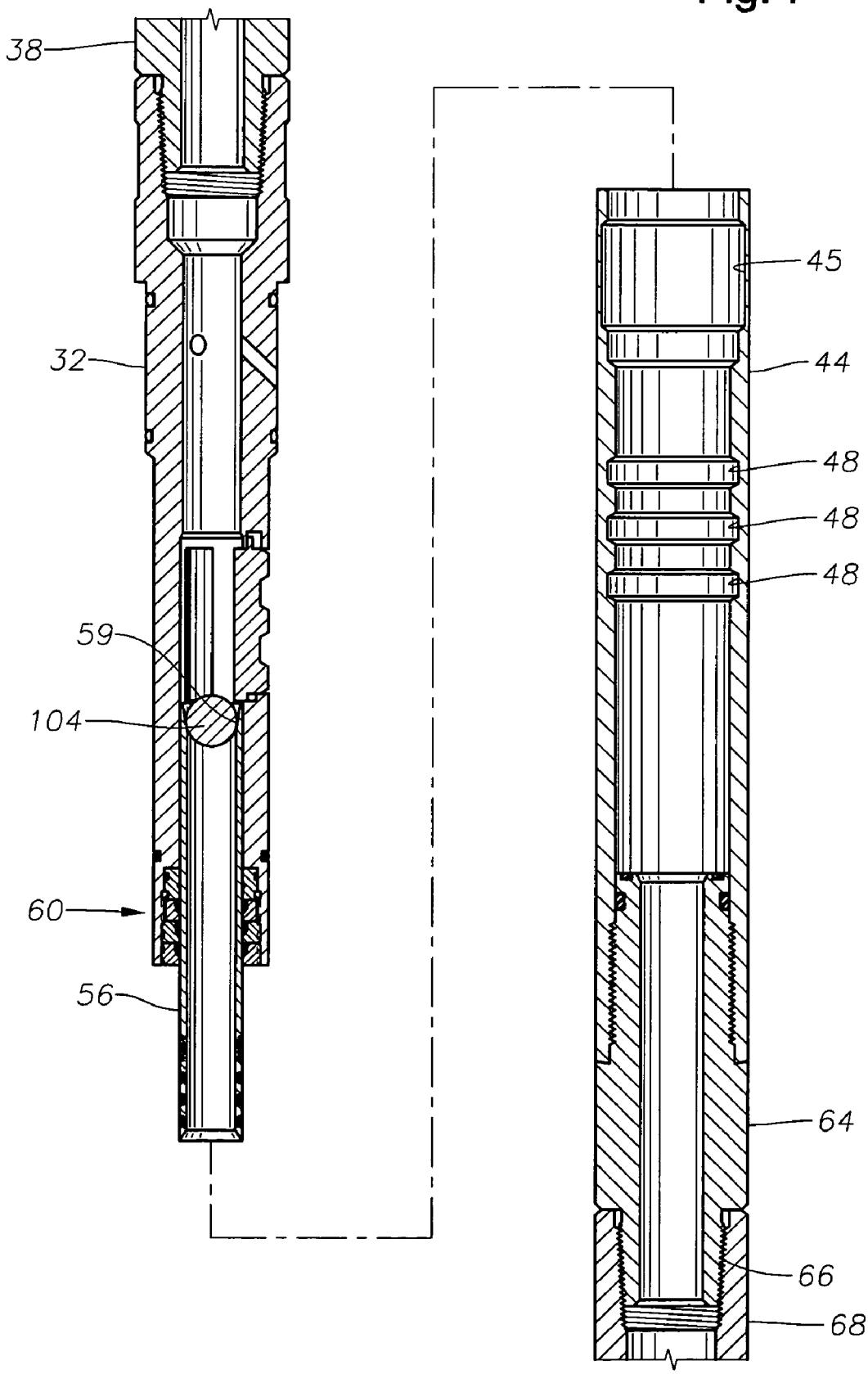
FIG. 7 is a side, cross-sectional view of the coiled tubing shear release joint shown in FIG. 3, with the release now activated.

As the shear sleeve 56 is moved downwardly to the position shown in FIG. 7, the dogs 50 are freed to move radially inwardly, and no longer engage the recesses 48 of the housing 44. The housing 44 becomes disconnected from the mandrel 32. The mandrel 32 and shear sleeve 56 can now be withdrawn from the wellbore, leaving the housing 44 and bottom sub 64 in the hole. The fishing neck 45 of the housing 44 remains available for later engagement by a fishing tool.

The shear disconnect assembly 60 may be assembled by first placing the mandrel 32 inside of the housing 44. The dogs 50 are then slid into place within the windows 42 of the mandrel 32. The outer collar 74 is slid over the shear sleeve 56 and the shear pin 76 is inserted through the outer collar 74 and inner collar 72. Next, the first O-ring shear member 84 is disposed into groove 90. The first shear collar 78 is then disposed over the shear sleeve 56 to trap the O-ring shear member 84 within its groove 90. The second O-ring shear member 86 is then disposed within groove 92. The second shear collar 80 is disposed over the shear sleeve 56 and brought into abutting relation to the first shear collar 78 to trap member 86 within the groove 92. The third O-ring shear member 88 is then disposed within groove 94, and the third shear collar 82 is slid over the shear sleeve 56 and brought into an abutting relation to the second shear collar 80. This action traps O-ring shear member 88 within groove 94. This, then completes the assembly of the shear disconnect assembly 60. Next, the shear sleeve 56, with affixed O-rings 84, 86, 88 and shear collars 78, 80, 82, is slid into the mandrel 32 so that the shear sleeve 56 is disposed beneath (i.e., radially within) the dogs 50, thereby holding them in place to secure the mandrel 32 to the housing 44. A spanning wrench may be used to tighten threaded connections and to axially preload the O-ring shear members 84, 86, 88. The bottom sub 64 is then secured to the housing 44.

It is noted that one can use additional O-ring seal members as shear members to increase the shear value of a connection or reduce the number of shear members in order to reduce the shear value of a connection. However, the shear value achieved by the use of additional shear members is not uniformly cumulative, as might have been expected. In practice, it has been observed, for example, that a single elastomeric shear element might provide a total shear resistance of about 1000 psi. The addition of a second, similar shear member will provide a total shear resistance of about 1,950 psi. The addition of a third shear member will provide a total shear resistance of about 2,750. Thus, the additional shear resistance resulting from the addition of a shear member is less than additive, indeed, only about 95% additional resistance is added. In determining the number of shear members to use for a given connection, one should take account of the conditions within the well in which the connection is expected to operate. Higher temperatures will make the O-rings easier to shear, and thus, the use of additional O-rings is desirable.

Those of skill in the art will recognize that elastomeric shear members might be used in many different types of devices that incorporate sliding sleeves that must be releasably secured to one another and released upon the application of a predetermined amount of axial force. Examples of wellbore tools that might make use of elastomeric shear members are sliding sleeve production valves and actuating tubes used to open a subsurface safety valve. It is further noted that the shear release joint 30, described above, might be used to provide a releasable disconnect joint for tubular members other than coiled tubing. For example, the release joint might be adapted for use with standard production tubing rather than coiled tubing.

It is noted that relatively pliable or substantially elastic materials other than elastomers can be used to form the shear members 24, 84, 86, 88. Suitable alternative materials would have to be suitably pliable and non-brittle in order to absorb expected vibratory energy from the device into which they are incorporated. Yet, these materials must still be able to provide the shear resistance necessary to retain the components in place until a predetermined amount of axial force is applied to the components to overcome that shear resistance. For example, annular members fashioned of plastics, polymers, resins, TEFLON®, or KEVLAR® would provide vibration resistance as well as provide suitable shear resistance for use as a shear member in a sliding sleeve device. A currently preferred type of material is standard N-butyl nitrile elastomer, of the type used to form conventional O-ring seals. These type of O-rings generally come in two hardnesses: 70 durometer and 90 durometer, both of which are suitable for use as a shear member. It is further noted that the shear member need not be annular in shape either, although that shape presently appears to be quite advantageous in use and is currently preferred.

The inventors have found that annular elastomeric shear members provide an unexpectedly high degree of shear resistance. It is believed that this significant shear resistance is due to the fact that the annular shear member must be sheared through its cross-section along its entire annular structure. In the above-described examples, the O-ring shear members 24, 84, 86, 86 are sheared by the action of a cutting edge that is incorporated into one or both of the sleeve members that enclose the shear members. In the case of the sliding sleeve assembly 10, the O-ring shear members 24 are sheared, or annularly divided, by the edges of the grooves 16, which are formed on the outer sleeve 18, and the edges of the grooves 20 that are formed on the inner piston 14. In the instance of the coiled tubing release joint 30, each O-ring shear member, such as 88, is sheared or divided by the forward cutting edge 102 of the radially outlying shear collar.

Those of skill in the art will recognize that numerous modifications and changes may be made to the exemplary designs and embodiments described herein and that the invention is limited only by the claims that follow and any equivalents thereof.

What is claimed is:

1. A vibration-resistant sliding sleeve assembly comprising:

a first sleeve member;

a second sleeve member slidably disposed radially within the first sleeve member;

a pliable shear member that releasably secures the second sleeve member against axial movement with respect to the first sleeve member, the shear member being pliable for absorption of vibratory energy, the shear member further providing a cross-sectional area; and the first and second sleeve members being released upon application of a predetermined axial force sufficient to shear the shear member through the cross-sectional area, the shear member thereupon being sheared through the cross-sectional area to release the first sleeve member from the second sleeve member.

2. The sliding sleeve assembly of claim 1 wherein the shear member is annular in shape.

3. The sliding sleeve assembly of claim 1 wherein the shear member is formed of at least one material from the group consisting of elastomer, plastic, polymer, and resin.

4. The sliding sleeve assembly of claim 1 wherein the shear member is substantially formed of elastomer.

5. The sliding sleeve assembly of claim 1 further comprising a groove formed within the second sleeve member and wherein the shear member resides at least partially within the groove.

6. The sliding sleeve assembly of claim 5 further comprising a cutting edge formed upon at least one sleeve member for shearing of the shear member.

7. The sliding sleeve assembly of claim 5 further comprising a shear collar that radially surrounds the shear member and is axially moveable with respect to the second sleeve member, the shear collar presenting a cuffing edge for annularly dividing the shear member through the cross-section.

8. The sliding sleeve assembly of claim 7 wherein the shear collar further comprises an arcuately curved inner surface that adjoins and lies radially outside of the annular shear member and compresses the shear member radially inwardly during axial movement of the shear collar with respect to the second sleeve member.

9. A shear release joint for use in creating a selective separation point between tubular members, the shear release joint comprising:

a first joint portion having a length and being secured to a first tubular member section and defining an axial bore along the length;

a second joint portion secured to a second tubular member section and releasably secured to the first joint portion;

a shear sleeve disposed within the axial bore and releasably retained within the bore by a shear disconnect assembly; and the shear disconnect assembly having at least one shear member formed of a pliable material for absorption of vibratory energy and being sheared upon application of a predetermined axial force to free the shear sleeve and release the first joint portion from the second joint portion.

10. The shear release joint of claim 9 wherein the shear member is annular in shape.

11. The shear release joint of claim 9 wherein the shear disconnect assembly comprises:

a groove on the shear sleeve for receiving a portion of the shear member; and a shear collar that radially surrounds the shear member and is axially moveable with respect to the shear sleeve, the shear collar presenting a cutting edge for annularly dividing the shear member through a cross-section of the shear member.

12. The shear release joint of claim 9 wherein the shear member is substantially formed of elastomer.

13. The shear release joint of claim 9 wherein the first and second tubular member portions comprise sections of coiled tubing.

14. The shear release joint of claim 9 wherein the predetermined axial force is applied to the shear sleeve.

15. A method of releasably securing a sliding sleeve arrangement comprising the steps of:

disposing a first sleeve member radially within a second sleeve member so that the first sleeve member is axially moveable with respect to the second sleeve member;

releasably securing the first and second sleeve members against axial movement with respect to one another by a pliable shear member for absorption of vibratory energy; and applying an axial force to shear the shear member and release the first sleeve member from the second sleeve member.

16. The method of claim 15 wherein the step of releasably securing the first and second further comprises disposing the pliable shear member at least partially within a groove and the shear member is sheared by a cutting edge that divides the shear member cross-sectionally.

17. The method of claim 16 wherein the step of applying axial force to shear the shear member comprises:

(a) landing a ball upon a ball seat associated with a shear sleeve, the shear sleeve having a cutting edge for shearing the shear member; and (b) applying fluid pressure upon the ball to urge the shear sleeve axially and cause the cutting edge to shear the shear member.

18. The method of claim 17 wherein the first and second sleeve members are further releasably secured to each other by a locking dog member that is released upon axial movement of the shear sleeve.

* * * * *